United States Patent [19]

Miyake

[11] Patent Number: 4,715,540

[45] Date of Patent: Dec. 29, 1987

[54] FUEL-INJECTION NOZZLE

[75] Inventor: Hiroshi Miyake, Osaka, Japan

[73] Assignee: Daihatsu Motor Company Limited, Osaka, Japan

[21] Appl. No.: 843,830

[22] Filed: Mar. 26, 1986

Related U.S. Application Data

[63] Continuation of Ser. No. 567,010, Dec. 30, 1983, abandoned.

[30] Foreign Application Priority Data

Jan. 17, 1983 [JP] Japan ..... 58-6254

[51] Int. Cl.[4] ..... F02M 47/00

[52] U.S. Cl. ..... 239/533.3

[58] Field of Search ..... 239/452, 453, 456, 459, 239/460, 86, 95, 584, 585, 533.1–533.12

[56] References Cited

U.S. PATENT DOCUMENTS 4,375,274 3/1983 Thoma et al. ..... 239/117
4,440,348 4/1984 Burgio di Aragona ..... 239/533.12

FOREIGN PATENT DOCUMENTS 830591 7/1949 Fed. Rep. of Germany ... 239/533.3
2822675 11/1979 Fed. Rep. of Germany ... 239/533.4
530020 12/1940 United Kingdom .
531796 1/1941 United Kingdom .
558928 8/1941 United Kingdom ..... 239/533.9
725379 3/1955 United Kingdom .
2083134A 3/1982 United Kingdom .
2088950 6/1982 United Kingdom ..... 239/533.9

*Primary Examiner*—Andres Kashnikow
*Assistant Examiner*—Kevin P. Weldon
*Attorney, Agent, or Firm*—Robbins & Laramie

[57] ABSTRACT

A fuel injection nozzle is disclosed, which comprises a nozzle body provided with an injection hole. A nozzle needle is slidably fitted into the nozzle body, to open or close the injection hole of the nozzle body. The nozzle needle is provided with a needle pin which is insertable into the injection hole. The needle pin involves a taper section which is progressively slenderized toward the combustion chamber of an internal combustion engine. A plurality of axially extending flattened surface portions are formed on the outer peripheral wall of the taper section of the needle pin. As a result, the annular gap region defined between the outer peripheral wall of the needle pin and the inner peripheral wall of the injection hole entails wider and narrower gap sections.

6 Claims, 9 Drawing Figures

FUEL-INJECTION NOZZLE

This application is a continuation of application Ser. No. 567,010, filed Dec. 30, 1983, now abandoned.

BACKGROUND OF THE INVENTION

This invention relates to a fuel-injection nozzle adapted for use with a diesel engine and, more particularly, to a pin-type fuel-injection nozzle.

The rate at which a fuel is injected into the combustion chamber of a diesel engine is controlled as indicated in FIG. 1. The fuel injection rate is so controlled that, although it is initially low, it rises substantially at the termination of the injection period. Thus, an attempt is made to minimize the effects of diesel knocking and the accompanying noises. Therefore, the diesel engine involves a pin-type fuel-injection nozzle which is capable of allowing for the fuel-injection characteristic illustrated in FIG. 1. However, the above-mentioned pin-type fuel-injection nozzle has certain drawbacks, in that carbon particles are deposited on the inner peripheral wall of the injection hole and the outer peripheral wall of the nozzle needle pin, tending to stop up the surrounding annular gap which is defined between the inner peripheral wall of the injection hole and the outer peripheral wall of the nozzle needle pin, and failing to stabilize the characteristic of the fuel injection rate shown in FIG. 1, for periods which run into hours.

The choke pin nozzle disclosed in U.S. Pat. No. 4,375,274 is intended to prevent the plugging of the above-mentioned annular gap resulting from the deposition of carbon particles. This known choke pin nozzle involves a nozzle needle which is rotatable around the axis of the choke pin nozzle during its operation. The nozzle needle of the published choke pin nozzle entails a choke pin which is offset from the axis of the injection hole. Therefore, the proposed choke pin nozzle, which is constructed as described above, has certain advantages, in that the rotation of the choke pin, in conjunction with the nozzle needle during operation, allows for the flushing out of carbon particles deposited on the outer peripheral wall of the choke pin and the inner peripheral wall of the injection hole, thereby suppressing the plugging of the annular gap defined between the inner peripheral wall of the injection hole and the outer peripheral wall of the choke pin.

According to the choke pin nozzle set forth in the U.S. Pat. No. 4,375,274, the choke pin is offset from the axis of the injection hole, thereby forming a single broader section on one half of the annular gap. It is intended to prevent carbon particles from depositing in the walls which define the broader gap section by the force of a fuel flowing along the broader gap section. However, the published fuel injection nozzle constructed as described above has the drawbacks that the aforementioned broader gap section unavoidably has a large open area; fuel is injected through the broader gap section in the form of coarse particles, thereby failing to be sufficiently atomized; and fuel is unevenly distributed, presenting difficulties in effectively reducing knock noises.

SUMMARY OF THE INVENTION

Accordingly, the primary object of this invention is to provide a fuel injection nozzle which can eliminate any harmful effects resulting from the deposition of carbon particles by means of a simple construction, stabilize the characteristic of the fuel injection rate over long periods, improve the various characteristics of the atomization, penetration and distribution of fuel over the whole region of preliminary fuel injection, whereby decreasing fuel cost, reducing knock noises and elevating the output of an internal combustion engine.

To attain the above-mentioned object, this invention provides a fuel-injection nozzle for injecting fuel into the combustion chamber of an internal combustion engine, which comprises:

a nozzle body having: a guide hole defined therein, a fuel accumulation chamber (which is also defined within the nozzle body) to receive fuel, and an injection hole communicating with the fuel accumulation chamber and opening into the combustion chamber;

a nozzle needle which is slidably inserted into the guide hole of the nozzle body, and is so urged as to close the injection hole of the nozzle body, which nozzle needle includes a needle pin, which, when the injection hole is stopped up by the nozzle needle, axially moves through the injection hole, and has a taper section formed at least in the injection hole in a form which is progressively slenderized toward the combustion chamber, thereby defining an annular gap between the outer peripheral wall of the needle pin and the inner peripheral wall of the injection hole; and a gap region which, when the pin of the nozzle needle occupies a prescribed position in the injection hole, is constituted by a series of wider and narrower gap sections arranged around the axis of the needle pin.

With the fuel-injecting nozzle embodying this invention, therefore, part of an annular gap defined between the inner peripheral wall of the injection hole and the outer peripheral wall of the needle pin is provided with wider gap sections. Therefore, the wider gap sections of the annular gap is not stopped up by the deposition of carbon particles. Moreover, the wider gap sections provided only in part of the whole annular gap prevent the fuel injection rate from undesirably increasing during initial stage of fuel injection.

Further, it is confirmed that a provision of a plurality of wider gap sections in separate places as is practised in this invention obstructs the full plugging of the narrower gap sections. This advantageous effect is assumed to arise from the fact that the adoption of the above-mentioned construction fully elevates the fuel pressure at the narrower gap sections. Therefore, the fuel injected into the combustion chamber of an internal combustion engine through the aforementioned wider gap sections can be carried to a remote region in the comparatively coarse form. On the other hand, the fuel injected into the combustion chamber through the narrower gap sections are pulverized into fine particles and spread in the form of a thin mist. Furthermore, the wider and narrower gap sections are alternately arranged in the circumferential direction of the needle pin. As a result, larger fuel particles having a sufficient force to be carried forward until they cease to burn and smaller fuel particles ready to be ignited are supplied to the combustion chamber of an internal combustion engine in the uniform and stable condition.

Moreover, the needle pin has a taper section progressively slenderized toward the combustion chamber of the internal combustion engine. While, therefore, the nozzle needle is lifted from the position in which the needle plugs the injection hole to the position in which the needle fully opens the injection hole, the fuel flow area in the wider and narrower gap sections smoothly increase. As a result, it is possible to elevate the penetration, atomization and distribution of fuel in good balance. Moreover, a very smooth transition can be effected from the preliminary fuel injection during which the injection hole is throttled to the full-scale fuel injection during which the injection hole is left fully open. Therefore, the fuel injection nozzle of this invention has the prominent advantage of decreasing fuel cost, reducing knock noises and elevating the output of an internal combustion engine.

With the fuel-injection nozzle of a aspect of the present invention, the wider gap sections of the annular gap may be provided by constructing a plurality of axially extending flattened surface portions on part of the outer peripheral wall of the needle pin. The flattened surface portions can be easily worked.

DETAILED DESCRIPTION OF THE PREFERRED EMBODIMENTS

Figure 2:
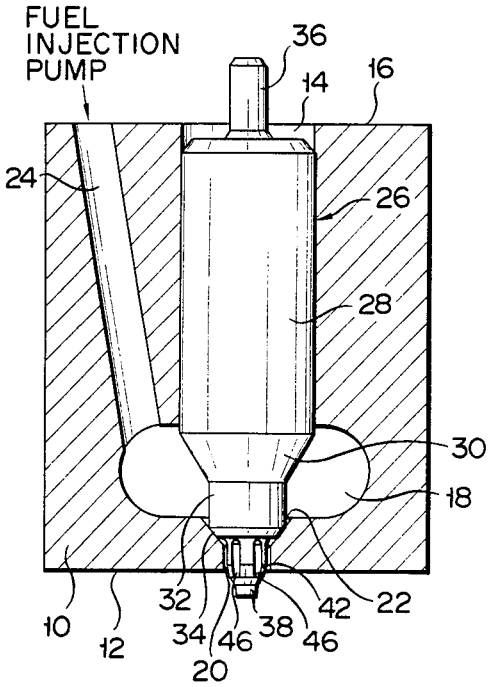
FIG. 2 is a fractional cross-sectional view of a fuel-injection nozzle according to a first embodiment of this invention.

A description may now be made, with reference to FIG. 2, of a fuel-injection nozzle according to a first embodiment of this invention, which nozzle is designed for use with a diesel engine. The fuel-injection nozzle involves a cylindrical body 10. The nozzle body 10 includes an injection end surface 12 facing the combustion chamber (not shown) of a diesel engine cylinder. The nozzle body 10 is fitted to a nozzle holder by means of a retaining nut. In FIG. 2, neither the retaining nut nor nozzle holder is shown. A guide hole 14 axially extends through the nozzle body 10. One end of the guide hole 14 is open to the other end surface 16 of the nozzle body 10. A fuel accumulation chamber 18 is defined within the nozzle body 10, in such a form as to communicate with the other end of the guide hole 14. A circular injection hole 20 is provided in the nozzle body 10, can concentrically with respect to the guide hole 14. This injection hole 20 communicates with the fuel accumulation chamber 18, at one end; and is open to the injection end surface 12 of the nozzle body 10, at the other end. That portion of the injection hole 20 which is close to the fuel accumulation chamber 18 has its inner diameter progressively broadened toward the fuel accumulation chamber 18. The inner peripheral wall of the tapered portion of the injection hole 20 constitutes the seat surface 22 of the nozzle body 10. A fuel feed passage 24 is formed within the nozzle body 10. This fuel feed passage 24 is open, at one end, to the other end surface 16 of the nozzle body 10, and communicates at the other end with the fuel accumulation chamber 18. As in the known fuel-injection nozzle, the fuel feed passage 24 is supplied at one end with high pressure fuel from a fuel-injection pump (not shown).

A nozzle needle 26 is inserted into the guide hole 14 of the nozzle body 10 in the axially slidable form. The nozzle needle 26 extends into the fuel accumulation chamber 18. This nozzle needle 26 involves a guide portion 28, taper portion 30, and small radius portion 32 which is more slender than the guide portion 28, as counted from above. Formed on the underside of the small radius portion 32 is a needle seat surface 34 which is capable of plugging the injection hole 20, in cooperation with the nozzle body seat surface 22 of the injection hole 20. The outer peripheral wall of the taper portion 30 serves as a pressure stage.

An integral journal portion 36 is concentrically provided at the upper end of the nozzle needle 26. This nozzle needle 26 is connected to a compression coil spring, through the journal portion 36 and pressure pin (not shown). The nozzle needle 26 is urged with a prescribed force, to close the injection hole 20 by means of the compression coil spring and pressure pin. The compression coil spring and pressure pin (not shown in FIG. 2) are received by the nozzle holder.

Figure 3:
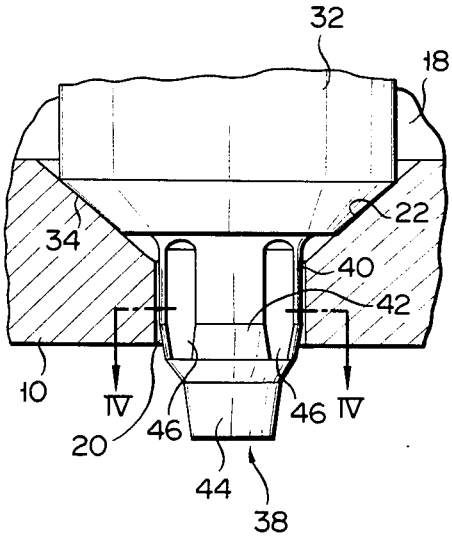
FIG. 3 is a fractional enlarged view of the fuel-injection nozzle of FIG. 2.
Figure 4:
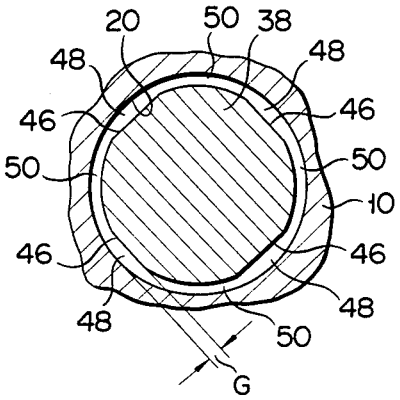
FIG. 4 is an enlarged cross-sectional view taken from line IV—IV of FIG. 3.

An integral needle pin 38 is projectively provided on the underside of the small radius portion 32. The needle pin 38 axially extends to such an extent as to penetrate the injection hole 20 when the injection hole 20 is stopped up by the nozzle needle 26. As may be seen from FIG. 3, the needle pin 38 involves a cylindrical section 40, taper section 42 and tip section 44, as counted from above. The taper section 42 is progressively slenderized toward the tip section 44. When the injection hole 20 is closed by the nozzle needle 26, the taper section 42 projects from the injection hole 20. Four axially extending flattened surface portions 46 are arranged at an equal circumferential distance, around the outer peripheral walls of the cylindrical section 40 and the taper section 42 of the needle pin 38. Thus, when the injection hole 20 is closed by the nozzle needle 26, the annular gap defined between the outer peripheral wall of the needle pin 38 and the inner peripheral wall of the injection hole 20 consists of wider gap sections 48 (defined between the flattened surface portions 46 and the inner peripheral wall of the injection hole 20) and narrower gap sections 50 (defined between the outer peripheral wall of the other portions of the needle pin 38 than those of the flattened surface portions 46 and the inner peripheral wall of the injection hole 20). In this case, the maximum width of the wider gap sections 48 is set at about 25 microns. As shown in FIG. 3, the flattened surface portions 46 respectively extend to the taper portion of the injection hole 20. The total open area of the annular gap is set at such a value as would allow for sufficient preliminary fuel injection during the initial stage of fuel injection.

A description may now be made of the operation of the above-mentioned fuel-injection nozzle. First, the nozzle needle 26 is held in a state in which the needle 26 stops up the injection hole 20 of the needle body 10 by the urging force of the compression coil spring. When, under such conditions, a prescribed amount of high pressure fuel is supplied from the fuel injection pump to the fuel accumulation chamber 18, through the feed passage 24 of the nozzle body 10, the pressure of the highly pressurized fuel is then acted upon the pressure stage 30 of the nozzle needle 26, thereby causing the nozzle needle 26 to be lifted upward (FIG. 2), against the urging force of the compression coil spring. As a result, the needle seat surface 34 of the nozzle needle 26 is removed from the nozzle body seat surface 22 of the injection hole 20, to open the injection hole 20. Therefore, the highly pressurized fuel held in the accumulation chamber 18 is injected into the combustion chamber through the injection hole 20. Later, when a prescribed amount of highly pressurized fuel is injected and the fuel pressure in the fuel accumulation chamber 18 is reduced, the nozzle needle 26 is brought downward by the urging force of the compression coil spring. As a result, the injection hole 20 is again closed by the nozzle needle 26, as shown in FIG. 2.

Figure 1:
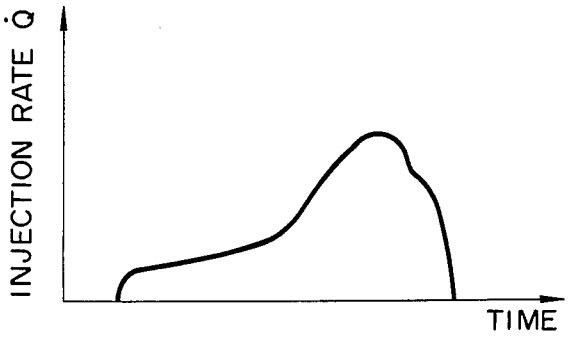
FIG. 1 indicates the characteristic of a fuel injection rate.

A detailed description may now be made of the conditions under which fuel is injected into the internal combustion chamber, from the start to the end. During the initial stage, the needle pin 38 of the nozzle needle 26 is still held in the injection hole 20. At this stage, high pressurized fuel is slightly injected through the annular gap defined between the outer peripheral wall of the needle pin 38 and the inner peripheral wall of the injection hole 20, i.e., mainly through the wider gap sections 48 of the annular gap. In the initial stage, therefore, a preliminary high pressurized fuel injection is carried out. Later, the nozzle needle 26 and, consequently, the needle pin 38 are lifted, causing fuel to be injected through the injection hole 20 at a progressively increased rate. Since the needle pin 38 is provided with the taper section 42, this increased rate of fuel injection is caused by the wider gap sections 48 of which the open area is increased, as the needle pin 38 is lifted. Later, when the needle pin 38 is further lifted, and the tip section 44 of the needle pin 38 reaches the taper portion of the injection hole 20, the injection hole 20 is opened wide, allowing high pressurized fuel to pass therethrough at a suddenly increased rate, during the terminal stage. Thereafter, the injection of high pressurized fuel is brought to an end. As a result, the fuel injection characteristic indicated in FIG. 1, which assures a decrease in the occurrence of diesel knocks and accompanying knocking noises, is obtained.

With the fuel injection nozzle embodying this invention, the annular gap defined between the outer peripheral wall of the needle pin 38 and the inner peripheral wall of the injection hole 20 includes wider gap sections 48. These wider gap sections 48 are prevented from being closed up, even when carbon particles are deposited on the flattened surface portions 46 partially defining the wider gap sections 48 and the inner peripheral wall of the injection hole 20.

The fuel injection nozzle of this invention enables fuel pressure in the narrower gap sections 50 to be maintained at a relatively high level, thereby eliminating the complete plugging of the narrower gap sections 50 under the normal operating condition of the internal combustion engine.

Furthermore, detailed description may be made of the condition in which fuel is injected. When the nozzle needle 26 is lifted from the lower dead point, high pressure fuel held in the fuel accumulation chamber 18 is slightly injected into the combustion chamber of the engine through the wider gap sections 48 involved in the annular gap. At this time, an extremely small amount of high pressure fuel is injected into the combustion chamber through the narrower gap sections 50 involved in the annular gap. As the nozzle needle 26 is more lifted, fuel tends to be injected into the combustion chamber in a larger amount through the wider gap sections 48 and narrower gap sections 50. This tendency becomes noticeable, after the taper section 42 of the needle pin 38 reaches the inner end of the injection hole 20. The process by which nozzle needle 26 is lifted from the position in which the injection hole 20 is closed to the position in which the injection hole 20 is left fully open progresses with time as follows. The fuel is injected into the combustion chamber in a smoothly increased amount. The distribution of fuel particles varies from the smaller to the larger particle size without obstruction. Therefore, transition from the preliminary fuel injection to the full scale fuel injection after the complete opening of the injection hole 20 is effected without sudden changes in the condition of fuel injection. At any point of time in the above-mentioned fuel injection, fuel having a force to sufficient to penetrate through the wider gap sections 48 and fuel injected through the narrower gap section 50 with a higher tendency toward atomization are always mixed, thereby assuring the satisfactory distribution of fuel particles. In other words, the satisfactory penetration, atomization and distribution of fuel is assured throughout the preliminary fuel injection. Moreover, the taper section 42 of the needle pin 38 enables the fuel injection to be delicately and continuously changed under an optimum condition.

Consequently, the fuel injection nozzle of this invention has the advantages that fuel ignition can be improved during the aforementioned preliminary fuel injection stage; average effective fuel pressure in the combustion chamber can be increased without difficulties; and the decrease of fuel cost, reduction of knock noises and elevation of the output of the internal combustion engine can be assured at the same time.

Figure 5:
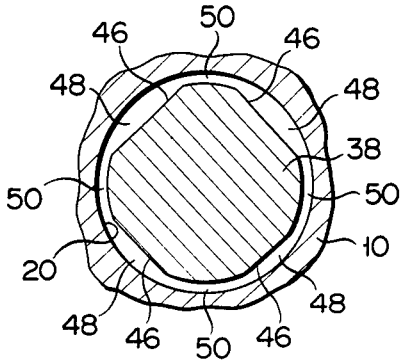
FIGS. 5 to 9 are cross-sectional views of the annular gaps provided in the fuel-injection nozzles according to various modifications of the invention.
Figure 6:
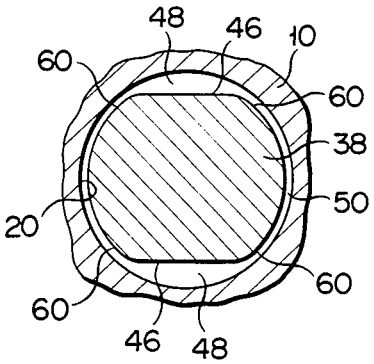
Figure 7:
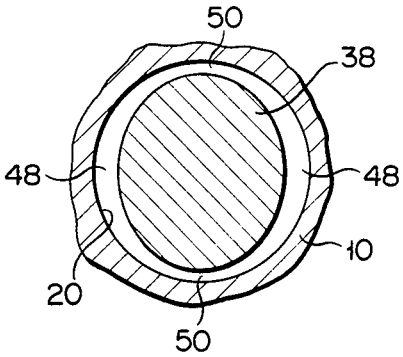
Figure 8:
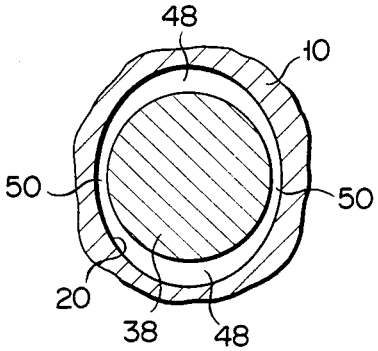
Figure 9:
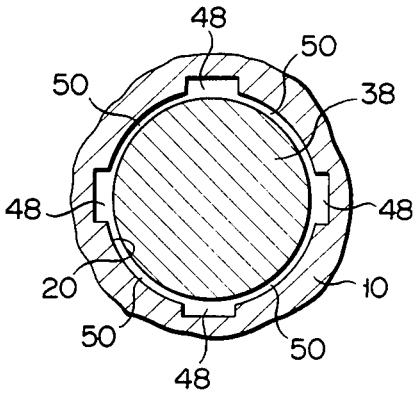

It should be noted that this invention is not limited to the above-mentioned embodiment, since it may be modified in various ways, as indicated in FIGS. 5 to 9. A description may now be made of the modifications. Referring to FIG. 5, the annular gap includes wider gap sections 48 having different maximum gap widths. FIG. 6 sets forth an annular gap including two wider gap sections 48. In this case, the plane defined between each flattened surface portion 46 of the needle pin 38 and the corresponding outer peripheral wall of the needle pin 38 is made into the arcuate form 60. As a result, the flattened surface portions 46 and the outer peripheral wall of the needle pin 38 may be brought into smooth continuation with each other. In other words, the gaps are progressively reduced in width, from the wider gap sections 48 to the narrower gap sections 50, thereby facilitating the atomization of the injected fuel. FIG. 7 illustrates an annular gap involving wider gap sections 48, with the needle pin 38 having an elliptical cross section. Unlike FIG. 7, FIG. 8 sets forth an annular gap including wider gap sections 48, with the injection hole 20 being made in an elliptical form. FIG. 9 shows an annular gap including wider gap sections 48 defined by four grooves formed in the inner peripheral wall of the injection hole 20.

What is claimed is:

1. A fuel-injection nozzle for injecting pressurized fuel into the combustion chamber of an internal combustion engine, comprising:

a nozzle body having a guide hole, a fuel accumulation chamber to receive pressurized fuel, an injection hole communicating with the fuel accumulation chamber and opening to the combustion chamber, and a body seat provided between the fuel accumulation chamber and the injection hole, wherein the guide hole, fuel accumulation chamber, body seat and injection hole are coaxially arranged;

a nozzle needle which is slidably fitted within the guide hole and which extends into the accumulation chamber, and which further has a needle seat at one end and is urged to make the needle seat contact the body seat to close the injection hole, and a needle pin coaxially projected from said end of the nozzle needle into the injection hole so that an annular gap is defined between the outer periphery of the needle pin and the inner periphery of the injection hole, the needle pin having a tapered portion progressively slenderized toward the combustion chamber for varying the rate of fuel injection through the annular gap when pressurized fuel in the fuel accumulation chamber urges the needle away from the body seat, and at least two flat surfaces on the outer periphery, the flat surfaces each at constant distance from a plane that is both parallel to the flat surface and contains the longitudinal axis of the needle pin; said flat surfaces extending from the needle seat of the nozzle needle along a portion of the needle pin for defining a series of wide and narrow sections around the annular gap; the maximum gap between at least one of the flat surfaces and the inner periphery of the injection hole being smaller than those between the other flat surfaces and the inner periphery of the injection hole;

the wide sections formed by the flat surfaces and inner periphery of the injection hole being of such shape whereby injected fuel passing therethrough is caused to be made up of particles of diverse sizes.

2. A fuel-injection nozzle for injecting pressurized fuel into the combustion chamber of an internal combustion engine, comprising:

a nozzle body having a guide hole, a fuel accumulation chamber to receive pressurized fuel, an injection hole communicating with the fuel accumulation chamber and opening to the combustion chamber, and a body seat provided between the fuel accumulation chamber and the injection hole, wherein the guide hole, fuel accumulation chamber, body seat and injection hole are coaxially arranged;

a nozzle needle which is slidably fitted within the guide hole and which extends into the accumulation chamber, and which further has a needle seat at one end and is urged to make the needle seat contact the body seat to close the injection hole, and a needle pin coaxially projected from said end of the nozzle needle into the injection hole so that an annular gap is defined between the outer periphery of the needle pin and the inner periphery of the injection hole, the needle pin having a tapered portion progressively slenderized toward the combustion chamber for varying the rate of fuel injection through the annular gap when pressurized fuel in the fuel accumulation chamber urges the needle away from the body seat, and at least two flat surfaces on the outer periphery, the flat surfaces each at constant distance from a plane that is both parallel to the flat surface and contains the longitudinal axis of the needle pin; said flat surfaces extending from the needle seat of the nozzle needle along a portion of the needle pin for defining a series of wide and narrow sections around the annular gap; the maximum gap between any one of the flat surfaces and the inner periphery of the injection hole being different from the maximum gap between the adjacent flat surface and the inner periphery of the injection hole;

the wide sections formed by the flat surfaces and inner periphery of the injection hole being of such shape whereby injected fuel passing therethrough is caused to be made up of particles of diverse sizes.

3. A fuel-injection nozzle according to claim 1, wherein the transition portion between each flat surface and an adjacent peripheral portion of the needle pin is a curved surface.

4. A fuel-injection nozzle according to claim 2, wherein the transition portion between each flat surface and an adjacent peripheral portion of the needle pin is a curved surface.

5. A fuel injection nozzle according to claim 1 wherein the needle pin includes at least three flat surfaces provided on the periphery.

6. A fuel injection nozzle according to claim 2 wherein the needle pin includes at least three flat surfaces provided on the periphery.

* * * * *